United States Patent [19]

Okada

[11] Patent Number: 4,865,541

[45] Date of Patent: Sep. 12, 1989

[54] IGNITION STONE CONTAINER OF CIGARETTE LIGHTER

[76] Inventor: Tsuneharu Okada, 1-59, Aza-Yatsuhari, Oaza-Ishihama, Higashiura-cho, Chita-gun, Aichi-ken, Japan

[21] Appl. No.: 261,246

[22] Filed: Oct. 21, 1988

[30] Foreign Application Priority Data

Feb. 9, 1988 [JP] Japan ..... 63-15226[U]

[51] Int. Cl.[4] ..... F23Q 2/38

[52] U.S. Cl. ..... 431/124; 431/253; 431/271; 431/273; 7/165

[58] Field of Search ..... 431/253, 124, 271, 273, 431/276, 267; 206/242, 87, 85, 86; 7/165

[56] References Cited

U.S. PATENT DOCUMENTS

| | | | |
|---|---|---|---|
| 1,889,849 | 12/1932 | Aronson | 431/124 |
| 2,825,216 | 3/1958 | Mosch | 431/124 |
| 2,828,855 | 4/1958 | Mosch | 431/253 X |
| 3,728,070 | 4/1973 | Rowlett | 431/124 |

*Primary Examiner*—Randall L. Green
*Attorney, Agent, or Firm*—Browdy & Neimark

[57] ABSTRACT

An ignition stone container which encloses ignition stones to be used in a cigarette lighter when an ignition stone in use is abraded and to be exchanged. A projection to rotate a locking screw threadedly attached to an ignition stone taking-in portion in the lighter is projected integrally with a container body. When an ignition stone contained in the lighter is abraded and firing failure occurs, top end portion of the projection being projected to the ignition stone container is touched to a screw head groove of the locking screw leading to an ignition stone enclosing portion in the lighter and then rotated, thereby the locking screw can be removed and the ignition stone can be exchanged. After the exchanging slao, the projection is touched to the screw head groove of the locking screw and rotated thereby the locking screw can be threadedly tightened. This projection serves as a screwdriver, and a particular operating tool for the locking screw is not required as long as this ignition stone container exists.

5 Claims, 1 Drawing Sheet

IGNITION STONE CONTAINER OF CIGARETTE LIGHTER

BACKGROUND OF THE INVENTION

The present invention relates to an ignition stone container which encloses ignition stones to be used in a cigarette lighter when an ignition stone in use is abraded and to be exchanged.

An ignition stone container in the prior art encloses several new ignition stones only for exchanging.

Consequently, in such a container, in order to exchange an ignition stone, a locking screw threadedly attached to an ignition stone taking-in portion in the lighter is removed using a screwdriver, a coin or the like.

SUMMARY OF THE INVENTION

An object of the invention is to provide an ignition stone container of a cigarette lighter, wherein a locking screw threadedly attached to an ignition stone taking-in portion of the lighter can be removed or attached by the ignition stone container without a screwdriver or a coin.

In order to attain the foregoing object, in an ignition stone container of a cigarette lighter according to the invention, a projection with a top end portion capable of being inserted in a screw head groove so as to rotate a locking screw threadedly attached to an ignition stone taking-in portion is projected integrally with the container body.

DESCRIPTION OF THE PREFERRED EMBODIMENTS

Figure 1:
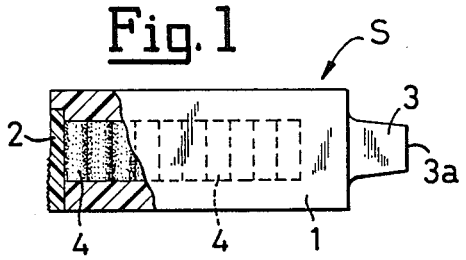
FIG. 1 is a plan view of an ignition stone container as an embodiment of the invention.
Figure 3:
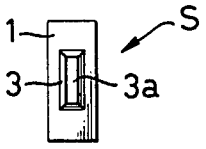
FIG. 3 is a right side view of the embodiment.
Figure 2:
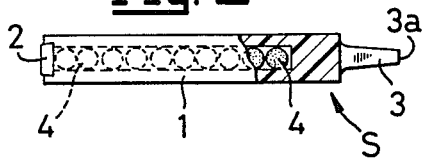
FIG. 2 is a front view of the embodiment.

An embodiment of the invention will now be described in detail referring to FIGS. 1 through 3.

An ignition stone container S of the embodiment comprises a rectangular container body 1 molded of plastic material, and a taking-out cover 2 slidably installed to an opening portion formed on one side of the container body 1. A short and thin projection 3 is projected in plastic molding integrally on other side of the container body 1.

A top end portion 3*a* of the projection 3 is made a thin shape with thickness Ea which can be inserted in a screw head groove of a locking screw threadedly attached to an ignition stone taking-in portion in a cigarette lighter. Also the container body 1 encloses new ignition stones 4 for exchanging.

Figure 4:
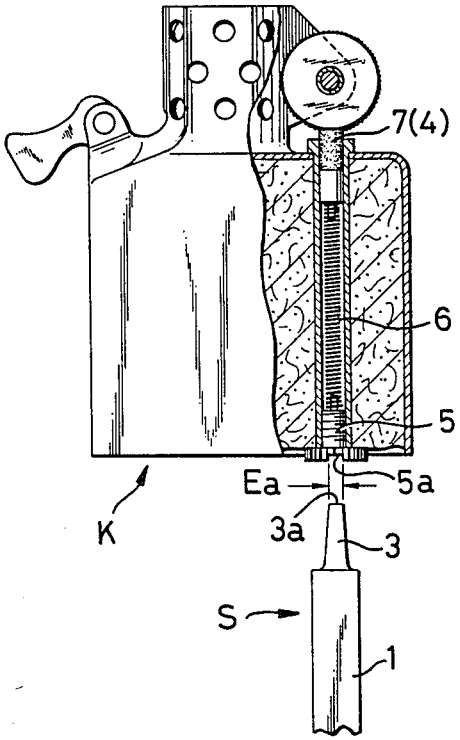
FIG. 4 is a front view partly in section of a lighter illustrating its use.

Operation of the embodiment will be described. When an ignition stone is abraded and firing failure of the cigarette lighter K occurs, first as shown in FIG. 4, the top end portion 3*a* of the projection 3 of the container S in the embodiment is inserted in a screw head groove 5*a* of the locking screw 5 threadedly attached to the ignition stone taking-in portion in the lighter K, and the container S is held and turned thereby the screw 5 is removed. That is, since the projection 3 serves as a screwdriver (screw turning tool), a screwdriver or the like need not be prepared.

After the screw 5 is removed, a spring 6 and the abraded ignition stone 7 within the lighter K are pulled out, and the cover 2 is removed and the abraded ignition stone 7 is exchanged for a new ignition stone 4 taken out of the container body 1 and the new ignition stone 4 is inserted in the lighter K, and then the spring 6 is entered and the screw 5 is threadedly attached. Also in order to lock the screw 5, the top end portion 3*a* of the projection 3 is inserted and the container S is held and turned thereby the screw 5 is threadedly attached.

Thus according to the embodiment, the ignition stone can be exchanged only using the ignition stone container S without a screw turning tool such as a screwdriver.

Figure 5:
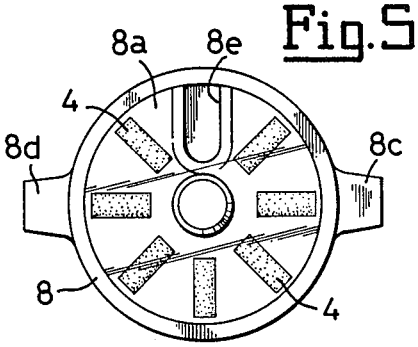
FIG. 5 is a plan view of an ignition stone container as another embodiment of the invention.
Figure 6:
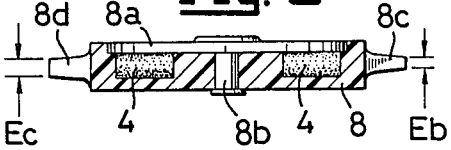
FIG. 6 is a longitudinal sectional view of the embodiment.

Next, a second embodiment will be described referring to FIGS. 5 and 6. In the embodiment, a container body 8 comprises a cover 8*a* which is rotatably connected by a pin 8*a* at center portion, and the cover 8*a* is rotated thereby an ignition stone 4 enclosed at the inside can be taken out from a notched portion 8*c* of the cover 8*a*. Thin projections 8*c*, 8*d* are opposed at lateral sides of the cover 8*a* and projected with short length. In this case, the thin projections 8*c*, 8*d* are different from each other in thickness at the top end portion.

That is, thickness Eb at the top end portion of one projection 8*c* is made thin, and thickness Ec of other projection 8*d* is made slightly thick. These projection 8*c*, 8*d* with thickness Eb, Ec are molded so that they can be inserted in screw head grooves of two sorts of locking screws threadedly attached to the ignition stone taking-in portion of the lighter.

Consequently, this embodiment can be applied also to the locking screws of two sorts of .different lighter products in similar manner to the, first embodiment.

Figure 7:
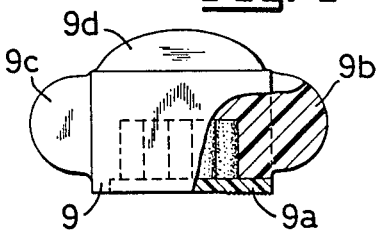
FIG. 7 is a plan view partly in section of an ignition stone container as still another embodiment of the invention.
Figure 8:
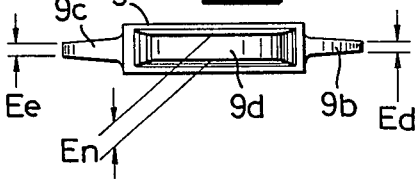
FIG. 8 is a rear elevation of the embodiment.

Further, a third embodiment will be described referring to FIGS. 7 and 8. In the embodiment, a rectangular container body 9 comprises a cover 9*a* which is slidably installed, and projections 9*b*, 9*c*, 9*d* having different thicknesses are projected at three lateral side portions other than the installation portion of the cover 9*a* integrally in plastic molding.

That is, thickness Ed at the top end portion of the projection 9*b* is made thin, and thickness Ee at the top end portion of the projection 9*c* is made slightly thicker than Ed, and further thickness En at the top end portion of the projection 9*d* is made slightly thicker than Ee.

In this case, side edges of respective projections 9*b*, 9*c*. 9*d* are curved.

Consequently, this embodiment can be applied also to the locking screws of three sorts of different lighter products in similar manner to the previous embodiments. Also since the side edges of respective projections 9*b*, 9*c*, 9*d* are curved, each projection is projected little and scratching becomes little.

Although respective embodiments are constituted as above described, the invention is not limited to these constitutions.

For example, material or shape of the container body or the taking-out constitution of the enclosed ignition stone from the container body may be arbitrarily selected.

Also shape of the projection is arbitrary as long as the top end portion of the projection can rotate the locking screw of the lighter.

According to the invention as above described, when the ignition stones in the cigarette lighter are exchanged, the locking screw of the lighter can be rotated by the projection of the ignition stone container. In this constitution, a screw turning tool such as a screwdriver becomes unnecessary, and the ignition stones can be exchanged anywhere as long as the ignition stone container exists.

Also if a plurality of projections having different thicknesses are furnished, the ignition stones can be exchanged even at lighters of different manufacturers.

Further when the projection is molded to lateral side of the container body integrally in plastic molding, the constitution is simplified and the manufacturing becomes low cost.

What is claimed is:

1. An ignition stone container body which encloses ignition stones to be used in a cigarette lighter for exchanging, comprising a projection with a top end portion capable of being inserted in a screw head groove of a locking screw for rotating the locking screw is projected integrally with said container body, said locking screw being threadedly attached to an ignition stone taking-in portion in said lighter.

2. An ignition stone container body as set forth in claim 1, wherein a plurality of projections are formed on said container body which are different from each other in thickness at each top end portion.

3. An ignition stone container body as set forth in claim 1 wherein said projection is projected at a lateral end portion of said container body.

4. An ignition stone container body as set forth in claim 1 wherein said projection is projected in a curved shape viewing from a plane at a lateral end portion of said container body.

5. An ignition stone container body as set forth in claim 3 wherein said container body and said projection are projected and formed integrally in a plastic molding.

* * * * *